US008307688B2

(12) United States Patent
Hidaka et al.

(10) Patent No.: US 8,307,688 B2
(45) Date of Patent: Nov. 13, 2012

(54) PROCESS FOR PRODUCING SEAMLESS STAINLESS STEEL PIPE

(75) Inventors: Yasuyoshi Hidaka, Osaka (JP); Toshihide Ono, Osaka (JP); Satoshi Matsumoto, Osaka (JP); Kouji Nakaike, Osaka (JP); Sumio Iida, Osaka (JP)

(73) Assignee: Sumitomo Metal Industries, Ltd., Osaka-shi, Osaka (JP)

( * ) Notice: Subject to any disclaimer, the term of this patent is extended or adjusted under 35 U.S.C. 154(b) by 1012 days.

(21) Appl. No.: 12/258,851

(22) Filed: Oct. 27, 2008

(65) Prior Publication Data

US 2009/0084151 A1 Apr. 2, 2009

Related U.S. Application Data

(63) Continuation of application No. PCT/JP2007/060391, filed on May 21, 2007.

(30) Foreign Application Priority Data

May 26, 2006 (JP) ..... 2006-146167

(51) Int. Cl.
*B21B 19/04* (2006.01)
*B21B 17/04* (2006.01)

(52) U.S. Cl. ..... 72/370.01; 72/97; 72/209

(58) Field of Classification Search ..... 72/200, 72/202, 208, 209, 342.1, 367.1, 368, 370.01, 72/97

See application file for complete search history.

(56) References Cited

U.S. PATENT DOCUMENTS 6,620,262 B1 * 9/2003 Okita et al. ..... 148/226
2008/0011037 A1 * 1/2008 Beppu ..... 72/208

FOREIGN PATENT DOCUMENTS

CH 596294 A5 3/1978

(Continued)

OTHER PUBLICATIONS

International Search Report from corresponding PCT/JP2007/060391 dated Aug. 21, 2007.

(Continued)

*Primary Examiner* — Debra Sullivan
(74) *Attorney, Agent, or Firm* — Marshall, Gerstein & Borun LLP

(57) ABSTRACT

A process for producing seamless pipes which comprises conducting a piercing rolling step, a elongating rolling step using a mandrel bar, and a sizing rolling step and subsequently conducting a product heat treatment. In the process, when the carbon-equivalent weight, namely the sum of the weight of graphite in the lubricant and the carbon content in the organic binder, per unit area of the lubricant adhering to the mandrel bar surface in the above-mentioned step of elongating rolling is expressed by C ($g/m^2$) or the maximum extent of carburization in the inner surface of the pipe to be heat-treated but prior to the heat treatment is expressed by ΔC (% by mass), the heating temperature for the pipe to be heat-treated is expressed by T (° C.), and the time during which a decarburizing gas is blown into the inside of the pipe to be heat-treated is expressed by $t_1$ or $t_2$ (seconds), and further, the blowing time calculated taking into account the wall thickness reduction in the step of cold working is expressed by $t_3$ or $t_4$ (seconds), a predetermined relation is satisfied and the actual decarburizing gas blowing time in the heat treatment is longer than the time $t_1$, $t_2$, $t_3$ or $t_4$ (seconds), whereby seamless stainless steel pipes reduced in carburized layer formation can be produced even when the carbon adhesion to the pipe inner surface is caused in, for example, mandrel mill rolling.

6 Claims, 1 Drawing Sheet

FOREIGN PATENT DOCUMENTS

| | | | |
|---|---|---|---|
| CH | 609728 | A5 | 3/1979 |
| JP | 62-068671 | | 3/1987 |
| JP | 04-168221 | | 6/1992 |
| JP | 07-278782 | | 10/1995 |
| JP | 08-057505 | | 3/1996 |
| JP | 08-090043 | | 4/1996 |
| JP | 09-078080 | | 3/1997 |
| JP | 09-201604 | | 8/2005 |

OTHER PUBLICATIONS

Written Opinion from corresponding PCT/JP2007/060391 dated Aug. 21, 2007. (Japanese language only).
International Preliminary Examination Report from corresponding PCT/JP2007/060391 dated Aug. 21, 2007. (Japanese language only).
Translation—International Preliminary Report on Patentability from corresponding PCT/JP2007/060391, 3 pages.

* cited by examiner

PROCESS FOR PRODUCING SEAMLESS STAINLESS STEEL PIPE

TECHNICAL FIELD

The present invention relates to a process for producing a seamless stainless steel pipe which comprises conducting a piercing rolling step, an elongating rolling step using a mandrel bar, for example a mandrel mill rolling, and a sizing rolling step, for example a stretch reducer rolling, and subsequently conducting a product heat treatment or conducting a product heat treatment after cold working, if necessary. More particularly, it relates to a process for producing a seamless stainless steel pipe according to which even in the case of carburized layer formation in the pipe inner surface as a result of contamination with graphite from the lubricant applied to the mandrel bar in elongating rolling, for example in mandrel mill rolling, or from the production line, the carburized layer can be decarburized in the subsequent product heat treatment, or in the mother pipe annealing heat treatment prior to cold working, or in the product heat treatment after cold working.

BACKGROUND ART

Seamless pipes are produced by conducting piercing rolling, elongating rolling using a mandrel bar, for example mandrel mill rolling, and sizing rolling, for example stretch reducer rolling and, further, subjecting the thus-obtained pipes, as mother pipes, to cold working, if necessary, generally in the manner described below. In the following, such production process is explained in connection with the case of applying mandrel mill rolling as elongating rolling and stretch reducer rolling as sizing rolling.

A round steel block (billet) is heated to a predetermined temperature (generally 1150-1250° C.) using a heating furnace, such as a rotary hearth type, and this billet is passed through an inclined roll type piercing/rolling machine for making a hollow shell. Then, a mandrel bar coated with a lubricant is inserted into the hollow shell and the hollow shell is passed, in the one pass manner, through a mandrel mill composed of 7 to 9 stands for roughening rolling to give a blank pipe having a predetermined size for finishing rolling, i.e. a finishing rolling blank pipe.

After this roughening rolling, the finishing rolling blank pipe is fed to a reheating furnace and reheated (generally to 900-1000° C.), the pipe outer surface alone is descaled by injecting high-pressure water jet, and the blank pipe is submitted to a stretch reducer rolling machine. Further, according to need, the pipe obtained by stretch reducer rolling is used as a mother pipe to be cold-worked and subjected to drawing working using a drawing machine or to cold working by cold rolling using a caliber roller such as a Pilger mill rolling machine to give the product seamless pipe.

On the occasion of the above-mentioned hot rolling of seamless pipes, the mandrel bar to be used in the step of roughening rolling on a mandrel mill is inserted into the hollow shell in a high-temperature condition (generally 1100-1200° C.) and thus exposed to a condition readily causing seizure by the hollow shell. The pipe profile and wall thickness after mandrel mill rolling is influenced by the roll revolving speed and roll caliber profile in the rolling step and further by the friction between the mandrel bar and the hollow shell. Therefore, for preventing the seizure of the mandrel by the hollow shell and for making the friction with the hollow shell proper so as to obtain the desired pipe profile and wall thickness, a lubricant is applied to the outer surface of the mandrel bar.

Known as such lubricant is, for example, a water-soluble lubricant based on graphite, which is inexpensive and has very good lubricating properties, as described in Japanese Patent Publication No. 59-37317, and this graphite-based lubricant has so far been used frequently. However, especially when the raw material is a stainless steel containing 10-30% by mass of Cr and roughening rolling is carried out using a mandrel bar coated with a graphite-based lubricant, the phenomenon of carburization occurs during rolling and a carburized layer having a higher carbon concentration than the carbon content in the substrate material is formed on the pipe inner surface side.

The main cause of the formation of a carburized layer in the pipe inner surface is the ingress of CO gas into steel matrix, the CO gas being formed from a part of graphite that is the main component of the inner surface lubricant, as well as from a part of carbon in the organic binder used therein, during mandrel mill rolling. As a result, the carbon concentration in a portion ranging from the inner surface to about 0.5 mm deep therefrom in a thickness-wise direction sometimes becomes higher by about 0.1% by mass than the carbon content in the base material, so that it may surpass the upper C content limit prescribed in Standard or the like in some cases.

In the carburized layer remaining at a level exceeding the prescribed limit, Cr, which is the main component forming a passivation film, namely an anticorrosive film, in stainless steel, is immobilized in the form of carbides, so that the corrosion resistance of the pipe inner surface is markedly deteriorated.

Therefore, those seamless stainless steel pipes which have allowed the formation of a carburized layer in the pipe inner surface cannot be shipped as products in as-is condition, so that means for causing the carburized layer to disappear are taken. For example, the pipe inner surface where a carburized layer remains is wholly polished or, in Japanese Patent Application Publication No. 09-201604, a special heat treatment method is proposed which comprises subjecting the pipe after finishing rolling to descaling so as to reduce the thickness of the oxidized scale layer in the pipe inner surface and then maintaining for 3-20 minutes the same in an oxidizing atmosphere at 1050-1250° C. for decarburization. However, these methods of causing the carburized layer portion to disappear have a problem in that a number of steps and considerable cost are required for the treatment.

Further, in Japanese Patent Application Publication No. 08-90043, it is proposed that, in the reheating treatment of the finishing rolling blank pipe, the blank pipe inside be filled with a gaseous atmosphere containing steam in an amount of not less than 10% by volume, followed by 2-10 minutes of heating at 980-1080° C. And, in the Example section, it is described that when the steam content is within the range of 0-9%, cracking tends to occur in corrosion testing. However, the production process according to Japanese Patent Application Publication No. 08-090043 requires a fairly large-scale steam production apparatus for continuously supplying steam in an amount of 10% or more through the pipe inside; this is not suited for mass production. Further, it becomes necessary to conduct solution heat treatment for decarburization after finishing rolling.

Further, Japanese Patent Application Publication No. 04-168221 proposes a process for producing austenitic stainless steel pipes which comprises subjecting a finishing rolling blank pipe, which is obtained by mandrel rolling using a graphite-based lubricant, to finishing rolling after 10-30 minutes of retention thereof in an atmosphere having an oxygen concentration of 6-15% within the temperature range of 950-

1200° C. However, the production process proposed in Japanese Patent Application Publication No. 04-168221 is impracticable from the yield viewpoint since the scale loss is great due to a long period of time required for heating the finishing rolling blank pipe.

Therefore, recently, positive efforts have been made for the development of graphite-free lubricants and methods of using the same, instead of the above graphite-based lubricant, and Japanese Patent Application Publication No. 09-78080, for instance, discloses a lubricant which comprises, as main ingredients, layered oxides, namely mica, and a borate salt and is completely free of carbon or, if any, contains only the carbon in an organic binder component and thus has a carbon content lowered as far as possible. The method of applying this graphite-free lubricant is the same as in the case of graphite-based lubricants, and the composition of the lubricant is designed so that the lubricant performance thereof may be equal to that of graphite-based lubricants.

Since, however, such a graphite-free lubricant as disclosed in Japanese Patent Application Publication No. 09-078080 is expensive as compared with graphite-based lubricants, it is not applied, for economic reasons, in rolling such materials that do not require any consideration of the problem of carburization layer formation in the pipe inner surface. In most of the recent product sector where seamless steel pipes are demanded, there is no need of consideration of the inner surface carburization and, therefore, in elongating rolling using a mandrel bar, for example in mandrel mill rolling, graphite-based lubricants are generally used from the economic viewpoint.

In the case of producing low-carbon stainless steel pipes, however, it is necessary to take the problem of inner surface carburization into consideration. In such a case, if the same mandrel bar as the one already used in elongating rolling of most other steels is used, graphite always remains on and is adhering to the surface of that mandrel bar even when a graphite-free lubricant is used only in the production of low-carbon stainless steel pipes.

The graphite applied to the mandrel bar surface in elongating rolling of carbon steel pipes or low alloy steel pipes is spread abundantly on the mandrel bar transfer line, in particular the transfer line between the area of lubricant application and the area of mandrel bar insertion into the hollow shell. Since, however, an unexpectedly large-scale apparatus is required for washing the production line, no sufficient washing is generally done and the contamination with graphite from the production line is inevitable.

Therefore, even when a graphite-free lubricant is applied to the surface of the mandrel bar for using the same in elongating rolling of low-carbon stainless steel pipes, the surface thereof (namely, the surface of the graphite-free lubricant film) is partly contaminated with the graphite already spread on the transfer line, irrespective of whether the mandrel bar has been submitted to elongating rolling with a graphite-based lubricant applied thereto or not.

This graphite partly adhering to the graphite-free lubricant film surface comes into direct contact with the workpiece, namely the hollow shell; this causes the formation of a partially carburized layer in the pipe inner surface after rolling. Thus, the formation of a carburized layer is caused although there is a difference in extent as compared with the case of using a graphite-based lubricant.

On the other hand, in cases where a mandrel bar already submitted to elongating rolling with a graphite-based lubricant applied thereto is used, graphite remains adhering thereto beneath the graphite-free lubricant film newly applied and, as a result of severe working on an elongating rolling mill, the graphite remaining beneath the film also comes into direct contact with the workpiece and causes the formation of a partial carburized layer in the pipe inner surface during rolling and in the subsequent steps.

In this way, even when a graphite-free lubricant is used in elongating rolling using a mandrel bar, a carburized layer is formed in the pipe inner surface and causes deterioration in corrosion resistance.

DISCLOSURE OF THE INVENTION

As mentioned hereinabove, even when a graphite-free lubricant is used in elongating rolling using a mandrel bar in the actual production shop, the mandrel bar surface is often contaminated with graphite and the problem of carburized layer formation in the inner surface, which leads to deterioration in corrosion resistance, arises.

Accordingly, an object of the present invention is to provide a process for producing seamless stainless steel pipes excellent in inner surface quality according to which the problem of such carburized layer formation in the pipe inner surface can be coped with and even if graphite contamination is produced by the lubricant and/or production line in elongating rolling using a mandrel mill, for example in mandrel mill rolling, in hot rolling of stainless steels pipes and the subsequent cold working to be conducted according to need, the carburized portion can be decarburized by the subsequent heat treatment and thus the carburized layer formed in the pipe inner surface can be reduced.

To accomplish the above object, the present inventors made detailed investigations concerning the behavior of carburization of the inner surface of steel pipes produced via the steps of piercing rolling, elongating rolling using a mandrel bar, for example mandrel mill rolling, and sizing rolling, and it was revealed that the carburization behavior in the commercial production equipment is influenced by the amount of carbon adhering to the mandrel bar surface.

More specifically, carbon-equivalent weight ($g/m^2$) on the mandrel bar surface was measured in the commercial production equipment, and attempts were made to quantify the effect of the carbon-equivalent weight ($g/m^2$) on the mandrel bar surface on the extent and depth of carburization in the steel pipe inner surface.

1. Results of Actual Measurements of Carbon-Equivalent Weight ($g/m^2$) on the Mandrel Bar Surface While it can be estimated that the carburization behavior in the commercial production equipment will be influenced by the amount of carbon adhering to the mandrel bar surface, the condition of carbon adherence to the mandrel bar surface in the commercial production equipment has not been shown in detail. Accordingly, commercial production measurements were made of the amounts of carbon adhering to the mandrel bar used in mandrel mill rolling among elongating rolling techniques using a mandrel bar.

The mandrel bar to be employed in a commercial production equipment was passed through the equipment without conducting mandrel mill rolling and, directly after the passage through the mandrel mill, the mandrel bar was taken out using a crane. Adhering substances were collected from the mandrel bar surface as samples, weighed and subjected to carbon content analysis. This method makes it possible to measure the sum of the amount of carbon originally adhering to the mandrel bar surface and the amount of carbon adhered from the production line prior to insertion on the mandrel mill.

As for the mandrel bar surface conditions and mandrel bar transfer line conditions, the following three categories, 1-3, of conditions were employed on that occasion.

Condition 1: The mandrel bar surface was not cleaned but was coated with a graphite-based lubricant, and the mandrel bar transfer line was not cleaned (the so-called ordinal rolling condition).

Condition 2: The mandrel bar surface was cleaned and coated with a graphite-free lubricant but the mandrel bar transfer line was not cleaned.

Condition 3: The mandrel bar surface was cleaned and coated with a graphite-free lubricant, and the mandrel bar transfer line was cleaned.

For establishing the above Conditions 2 and 3, the mandrel bar surface was cleaned using an ultrahigh pressure water washer and, after washing, the substantial absence of carbon (below 1.0 g/m$^2$) on the mandrel bar surface was confirmed by analysis.

For the measurements of amounts of carbon adhering to the mandrel bar surface, each sample of the substances adhering to the mandrel bar surface was collected, without omission, from a predetermined portion of the mandrel bar surface by polishing with a metal file until exposure of the base metal, and the total amount of the adhering substances was determined and evaluated by weight measurement and quantitative analysis of carbon. Eight to ten samples were collected from each mandrel bar and subjected to weight measurement and quantitative analysis and the amount of the substances adhering to the mandrel bar surface was determined in terms of carbon-equivalent weight; the maximum values for the respective categories of Condition such as mandrel bar surface conditions are shown in Table 1.

The carbon-equivalent weight (g/m$^2$), so referred to herein, means the total carbon-equivalent weight, per unit area of the lubricant layer adhering to the mandrel bar surface, of graphite and the carbon-equivalent content of the organic binder in the lubricant.

TABLE 1

| Commercial production equipment condition | Lubricant Type | Bar and line cleaning | Bar surface carbon-equivalent weight |
|---|---|---|---|
| Condition 1 | Graphite-based | No cleaning | 80 g/m$^2$ |
| Condition 2 | Graphite-free | *Cleaning | 42 g/m$^2$ |
| Condition 3 | Graphite-free | Cleaning | 12 g/m$^2$ |

Note)
Under Condition 2, the mandrel bar alone was cleaned.

As shown in Table 1, it could be grasped that, in commercial production mandrel mill rolling, the carbon-equivalent weight on the mandrel bar surface varies from 80 to 12 g/m$^2$ under the ordinary rolling condition, wherein Condition 1 corresponds to a normal rolling condition, Condition 3 indicates that the amount of adhering carbon can be expectedly minimized on the current rolling technology level, and Condition 2 is considered to be intermediate therebetween.

2. Extent of Influence of the Carbon-Equivalent Weight (g/m$^2$) on the Mandrel Bar Surface on the Extent of Carburization and the Carburized Layer Depth in the Inner Surface Layer For quantitatively assessing the influence of the mandrel bar surface carbon-equivalent weight (g/m$^2$) varying within the range shown above in Table 1 on the carburization behavior, investigations were made concerning the carburization-incurred increment in carbon concentration (i.e. extent of carburization) and the depth of carburization in the final product pipe inner surface in a commercial production equipment test while intentionally varying the carbon-equivalent weight on the mandrel bar surface.

As for the procedure in the commercial production equipment test, SUS 304 steel billets (200 mm in diameter, 3000 mm in length) having the chemical composition of Steel Grade A shown in Table 3, given hereinafter, were heated in the temperature range of 1150-1250° C. in a rotary hearth type heating furnace and pierced on a Mannesmann piercer to give hollow shells with an outside diameter of 200 mm and a wall thickness of 16 mm, which were then roughening rolled on a mandrel mill to give finishing rolling blank pipes with an outside diameter of 110 mm and a wall thickness of 5.5 mm.

On that occasion, in view of the investigation results shown above in Table 1, the carbon-equivalent weight on the mandrel bar surface was adjusted within the range of 10-80 g/m$^2$ by mixing a graphite-based lubricant with a graphite-free lubricant in a constant proportion and applying the thus-prepared lubricant.

The transfer line and each mandrel bar were cleaned in advance using an ultrahigh pressure water washer until the content of adhering carbon reaches a level not more than 1 g/m$^2$. After mandrel mill rolling, each blank pipe was reheated in a reheating furnace at a heating temperature of 1000° C. for a retention time of 20 minutes and then finishing-rolled on a stretch reducer to give a steel pipe with an outside diameter of 45 mm and a wall thickness of 5 mm.

Test pieces for carburization analysis were taken from the finishing-rolled steel pipe at 1-meter intervals, the scale on the steel pipe inner surface was removed by polishing with an emery paper and, after degreasing, carbon concentration measurements were made at 20 points using a Quantovac apparatus; the maximum value thereof was recorded as the maximum C concentration (% by mass). In the description below, "%" means "% by mass", and the value of {maximum C concentration (%) on the inner surface−C content in the middle of the wall thickness} is shown as the maximum extent of carburization on the pipe inner surface, namely in terms of ΔC.

FIG. 1 is a graphic representation of the extent of influence of the carbon-equivalent weight (g/m$^2$) on the mandrel bar surface on the maximum extent of carburization, ΔC, on the pipe inner surface. As shown in FIG. 1, the influence of the carbon-equivalent weight C (g/m$^2$) on the mandrel bar surface on the maximum extent of carburization, ΔC, on the pipe inner surface can be quantified by the following equation (5):

$$\Delta C = 6.25C \times 10^{-4} \quad (5)$$

FIG. 2 is a graphic representation of the extent of influence of the carbon-equivalent weight (g/m$^2$) on the mandrel bar surface on the carburized depth in the pipe inner surface. As shown in FIG. 2, the influence of the carbon-equivalent weight C (g/m$^2$) on the mandrel bar surface on the carburized depth, H (μm), in the pipe inner surface can be quantified by the following equation (6):

$$H = 2.5 \times C \quad (6)$$

The behaviors of the carbon-equivalent weight C (g/m$^2$) on the mandrel bar surface as shown in FIGS. 1 and 2 referred to above indicate that there is a correlation between the maximum extent of carburization on the pipe inner surface, ΔC, and the carburized depth, H, and, when C derived from the equation (5) is substituted for C in the equation (6), it is revealed that the smaller the maximum extent of carburization on the pipe inner surface, ΔC, is, the smaller the carburized depth in the pipe inner surface, H, is, as indicated by the equation (7) given below.

$$H=2.5\times C=2.5\times\{\Delta C/(6.25\times10^{-4})\}=4000\times\Delta C \quad (7)$$

If the carburized depth, H, can be estimated from the maximum extent of carburization, ΔC (%) on the pipe inner surface, or the carbon-equivalent weight C ($g/m^2$) on the mandrel bar surface, the carburized layer depth to be decarburized on the occasion of heat treatment of steel pipes can be estimated, as mentioned above. Then, even if carbon adhesion to the pipe inner surface is caused by the residual graphite-based lubricant and/or by the transfer thereof from the production line in elongating rolling using a mandrel bar, e.g. in mandrel mill rolling, the carburized layer can be decarburized in the subsequent heat treatment in response to the carbon-equivalent weight C ($g/m^2$) on the mandrel bar surface and, further, to the maximum carburization extent ΔC (%) on the pipe inner surface; the inventors came to realize this.

The gist of the present invention, which has been completed based on the above-mentioned investigation results, consists in a process for producing seamless stainless steel pipes as defined below under any of (1) to (6).

(1) A process for producing seamless stainless steel pipes in which the process comprises the steps of: piercing rolling; elongating rolling using a mandrel bar; and sizing rolling, followed by product heat treatment, characterized in that when the carbon-equivalent weight, namely the sum of the weight of graphite in and the carbon content of the organic binder in a lubricant used for the mandrel bar, per unit area of the lubricant adhering to the mandrel bar surface in the above-mentioned step of elongating rolling is C ($g/m^2$), and the heating temperature for the pipe to be heat-treated in the above-mentioned heat treatment is T (° C.), a decarburizing gas is blown into the inside of the pipe during the above-mentioned heat treatment for a period of time longer than the estimated gas blowing time $t_1$ (seconds) satisfying the relation defined by the equation (1) given below:

$$2.5\times C=\{1.326\times10^8\times t_1\times\mathrm{EXP}(-37460/1.987/(T+273))\}^{1/2} \quad (1)$$

(2) A process for producing seamless stainless steel pipes in which the process comprises the steps of: piercing rolling; elongating rolling using a mandrel bar; and sizing rolling, followed by product heat treatment, characterized in that when the maximum extent of carburization in the inner surface of the pipe to be heat-treated but prior to the above-mentioned heat treatment is ΔC (%), and the heating temperature for the pipe to be heat-treated in the above-mentioned heat treatment is T (° C.), a decarburizing gas is blown into the inside of the pipe during the above-mentioned heat treatment for a period of time longer than the estimated gas blowing time $t_2$ (seconds) satisfying the relation defined by the equation (2) given below:

$$4000\times\Delta C=\{1.326\times10^8\times t_2\times\mathrm{EXP}(-37460/1.987/(T+273))\}^{1/2} \quad (2)$$

(3) A process for producing seamless stainless steel pipes in which the process comprises the steps of: piercing rolling; elongating rolling using a mandrel bar; and sizing rolling, followed by cold working, characterized in that when the carbon-equivalent weight, namely the sum of the weight of graphite in and the carbon content of the organic binder in a lubricant used for the mandrel bar, per unit area of the lubricant adhering to the mandrel bar surface in the above-mentioned step of elongating rolling, is C ($g/m^2$), the heating temperature for the pipe to be heat-treated in the heat treatment prior to the above-mentioned cold working and/or in the heat treatment after the cold working is T (° C.), and a decarburizing gas is blown into the inside of the pipe during the above-mentioned heat treatment for a period of time longer than the estimated gas blowing time $t_1$ (seconds) satisfying the relation defined by the equation (1) given hereinabove.

(4) A process for producing seamless stainless steel pipes in which the process comprises the steps of: piercing rolling; elongating rolling using a mandrel bar; and sizing rolling, followed by cold working, characterized in that when the maximum extent of carburization in the inner surface of the pipe to be heat-treated but prior to the heat treatment before and/or after the above-mentioned cold working is ΔC (%), the heating temperature for the pipe to be heat-treated in the above-mentioned heat treatment is T (° C.), a decarburizing gas is blown into the inside of the pipe during the above-mentioned heat treatment for a period of time longer than the calculated gas blowing time $t_2$ (seconds) satisfying the relation defined by the equation (2) given hereinabove.

(5) A process for producing seamless stainless steel pipes in which the process comprises the steps of: piercing rolling; elongating rolling using a mandrel bar; sizing rolling; and cold working, followed by heat treatment, characterized in that when the carbon-equivalent weight, namely the sum of the weight of graphite in and the carbon content of the organic binder in a lubricant used for the mandrel bar, per unit area of the lubricant adhering to the mandrel bar surface in the above-mentioned step of elongating rolling is C ($g/m^2$), the heating temperature for the pipe to be heat-treated in the heat treatment following the above-mentioned cold working is T (° C.), the wall thickness of the pipe before the cold working is $W_0$ and further, the wall thickness of the pipe after the cold working is $W_1$, a decarburizing gas is blown into the inside of the pipe during the above-mentioned heat treatment for a period of time longer than the estimated gas blowing time $t_3$ (seconds) satisfying the relation defined by the equation (3) given below:

$$(W_1/W_0)\times2.5\times C=\{1.326\times10^8\times t_3\times\mathrm{EXP}(-37460/1.987/(T+273))\}^{1/2} \quad (3)$$

(6) A process for producing seamless stainless steel pipes in which the process comprises the steps of: piercing rolling; elongating rolling using a mandrel bar; sizing rolling; and cold working, followed by heat treatment, characterized in that when the maximum extent of carburization in the inner surface of the pipe to be heat-treated prior to the above-mentioned cold working is ΔC (% by mass), the heating temperature for the pipe to be heat-treated in the heat treatment following the above-mentioned cold working is T (° C.), the wall thickness of the pipe before the cold working is $W_0$ and further, the wall thickness of the pipe after the cold working is $W_1$, a decarburizing gas is blown into the inside of the pipe during the above-mentioned heat treatment for a period of time longer than the estimated gas blowing time $t_4$ (seconds) satisfying the relation defined by the equation (4) given below:

$$(W_1/W_0)\times4000\times\Delta C=\{1.326\times10^8\times t_4\times\mathrm{EXP}(-37460/1.987/(T+273))\}^{1/2} \quad (4)$$

The "elongating rolling using a mandrel bar" so referred to herein is not limited to the mandrel mill rolling mentioned above by way of example but includes rolling methods for carrying out elongating rolling with a mandrel bar inserted into the inside of a hollow shell produced by piercing rolling, represented by for example Pilger mill rolling or Assel mill rolling, as well. In each case, the problem of carburization in the pipe inner surface arises due to the lubricant applied to the mandrel bar surface.

Further, the "sizing rolling" so referred to herein is a rolling operation for adjusting the outside diameter and wall thickness of the finishing rolling blank pipe as obtained by the above "elongating rolling using a mandrel bar" to the desired dimensions; stretch reducer rolling and sizer rolling correspond thereto.

The "cold working" so referred to herein includes, within the meaning thereof, cold drawing using a drawing machine and cold working by cold rolling using caliber rolls, for example a Pilger mill rolling machine.

In accordance with the process for seamless stainless steel pipe production according to the present invention, the carburized depth, H, can be estimated from the carbon-equivalent weight C ($g/m^2$) on the mandrel bar surface and/or the maximum extent of carburization, ΔC (%), on the pipe inner surface, even when the residual graphite-based lubricant and/or the transfer and spreading thereof from the production line causes the adhesion of carbon to the pipe inner surface in elongating rolling using a mandrel bar, for example in mandrel mill rolling and, therefore, by controlling the heating temperature T (° C.) for the pipe to be heat-treated in the subsequent heat treatment as well as the decarburizing gas blowing time $t_1$, $t_2$, $t_3$ or $t_4$ (seconds), it becomes possible to reduce the carburized layer by decarburization of the carburized portion and obtain seamless steel pipes excellent in inner surface quality.

BEST MODES FOR CARRYING OUT THE INVENTION

Figure 1:
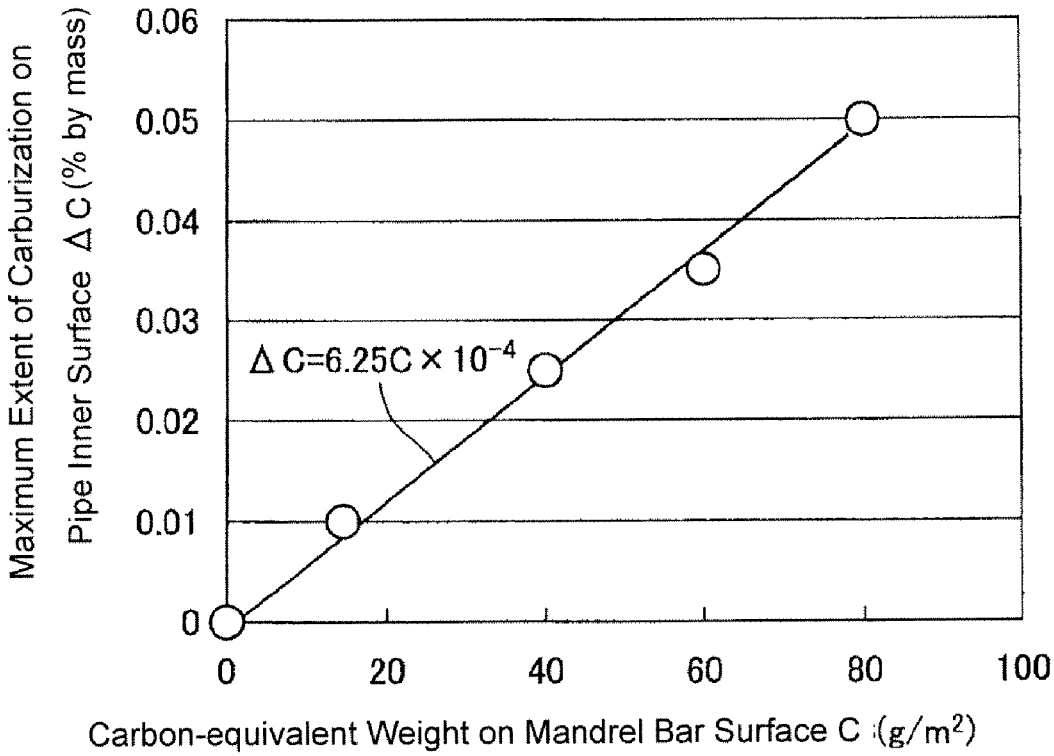
FIG. 1 is a graphic representation of the extent of influence of the carbon-equivalent weight ($g/m^2$) on the mandrel bar surface on the maximum extent of carburization, ΔC, on the pipe inner surface.

The process for seamless stainless steel pipe production according to the present invention is characterized in that when the carbon-equivalent weight on the mandrel bar surface, from which the carburized depth in the subsequent heat treatment can be estimated in cases where the adhesion of carbon coming from the lubricant and/or production line in elongating rolling using a mandrel bar, for example in mandrel mill rolling, is C ($g/m^2$), and the heating temperature for the pipe to be heat-treated in the above-mentioned heat treatment is T (° C.), a decarburizing gas is blown into the inside of the pipe during the above-mentioned heat treatment for a period of time longer than the estimated gas blowing time $t_1$ (seconds) satisfying the relation defined by the equation (1) given later herein.

In another aspect, the process for seamless stainless steel pipe production according to the present invention is characterized in that when the maximum extent of carburization, ΔC, on the pipe inner surface, from which the carburized depth in the subsequent heat treatment in the same cases as mentioned above can be estimated, is ΔC (%), and the heating temperature for the pipe to be heat-treated in the above-mentioned heat treatment is T (° C.), a decarburizing gas is blown into the inside of the pipe during the above-mentioned heat treatment for a period of time longer than the estimated gas blowing time $t_2$ (seconds) satisfying the relation defined by the equation (2) given later herein.

In yet another aspect, the process for seamless stainless steel pipe production according to the present invention is characterized in that when, in the case of conducting cold working and then heat treatment, the carbon-equivalent weight on the mandrel bar surface, from which the carburized depth in the subsequent heat treatment can be estimated, is C ($g/m^2$), or the maximum extent of carburization on the pipe inner surface, from which the carburized depth in the subsequent heat treatment can be estimated, is ΔC (%), the pipe wall thickness before cold working is given by $W_0$ and the pipe wall thickness after cold working is given by $W_1$, both of which make it possible to estimate the carburized depth in the subsequent heat treatment when the reduction in wall thickness in the step of cold working is taken into account, and the heating temperature for the pipe to be heat-treated in the heat treatment following the above-mentioned cold working is T (° C.), a decarburizing gas is blown into the inside of the pipe during the heat treatment for a period of time longer than the estimated gas blowing time $t_3$ or $t_4$ (seconds) satisfying the relation defined by the equation (3) or (4) given later herein.

In carrying out the production process according to the present invention, it is necessary to blow a decarburizing gas into the inside of the pipe to be heat-treated in the heat treatment and producing a decarburizing atmosphere on the pipe inner surface side so as to decarburize the carburized layer resulting from carbon adhesion to the pipe inner surface. For that purpose, a means for directly blowing a decarburizing gas from a nozzle directed toward the pipe inner surface may be employed, or a decarburizing gas used as the furnace atmosphere gas may be blown into the pipe to be heat-treated so as to pass through the same from one end thereof to the other by utilizing the pressure difference between the opposite pipe ends by virtue of the furnace pressure in the heat treatment furnace.

Usable as the "decarburizing gas" in the practice of the present invention are decarburizing gases, inclusive of oxidizing gases, such as oxygen, carbon dioxide and steam, and these gases may be used in admixture with a non-oxidizing gas such as nitrogen gas, hydrogen gas and/or rare gas.

In the production process according to the present invention, the decarburizing effect in the heat treatment using the above-mentioned "decarburizing gas" can be defined based on the diffusion behavior of carbon (C) in γ-Fe. Thus, the diffusion coefficient D ($cm^2$/second) of carbon (C) is given by the following equation (8), where T (° C.) is the heating temperature for the material to be heat-treated:

$$D=0.663-\mathrm{EXP}(-37460/1.987/(T+273)) \tag{8}$$

Then, the distance X (cm) across which carbon (C) diffuses through the material to be heat-treated during the time t (seconds) is given by the following equation (9):

$$X=(2Dt)^{1/2} \tag{9}$$

Figure 2:
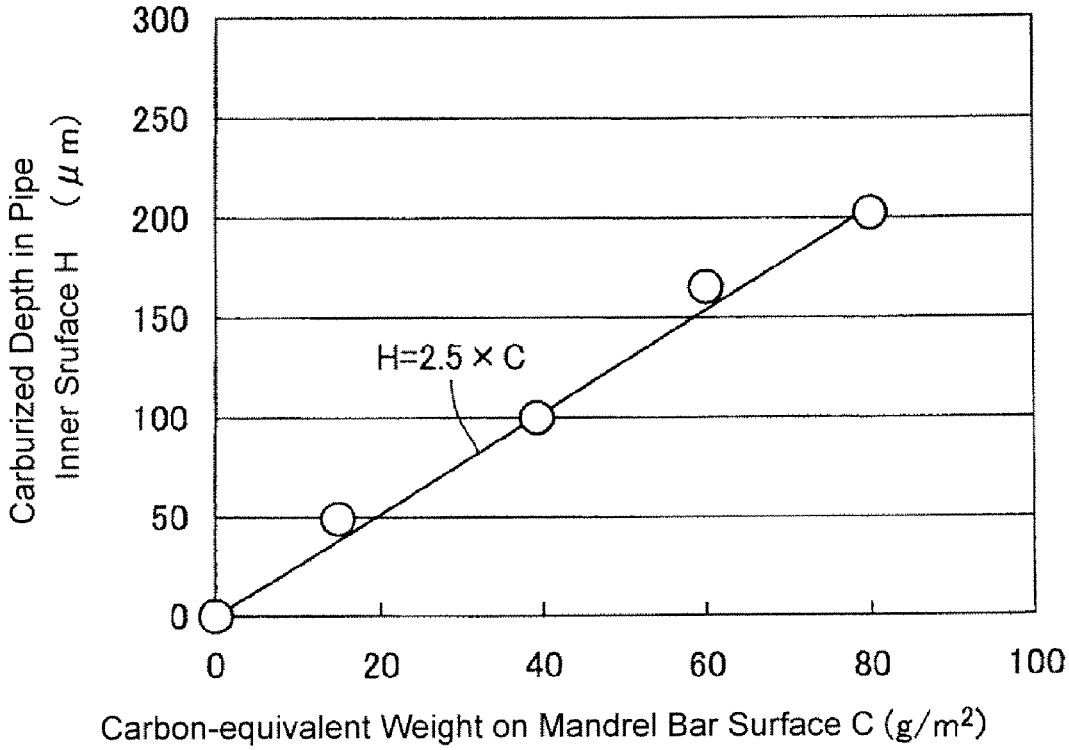
FIG. 2 is a graphic representation of the extent of influence of the carbon-equivalent weight ($g/m^2$) on the mandrel bar surface on the carburized depth in the pipe inner surface.

In the production process according to the present invention, the carburized depth, H (μm), which is to be decarburized in the heat treatment, corresponds to the distance of diffusion, X (cm), as indicated by the above equation (9), and substitution of the above equations (8) and (9) into the equation (6) shown in FIG. 2 referred to hereinabove gives the relation represented by the following equation (1a):

$$H=2.5\times C=X\times 10^4=(2Dt)^{1/2}\times 10^4=\{2\times 0.663\times 10^8\times t\cdot \mathrm{EXP}(-37460/1.987/(T+273))\}^{1/2} \tag{1a}$$

Here, when, in the relation represented by the above equation (1a), the carbon-equivalent weight, namely the sum of the weight of graphite in and the carbon content of the organic binder in a lubricant used for the mandrel bar, per unit area of the lubricant adhering to the mandrel bar surface, is expressed as C (g/m$^2$), the heating temperature for the pipe to be heat-treated in the heat treatment as T (° C.) and the time during which a decarburizing gas is blown into the inside of the pipe to be heat-treated as $t_1$ (seconds), the relation represented by the following equation (1) can be satisfied.

$$2.5\times C=\{1.326\times10^8\times t_1\times \mathrm{EXP}(-37460/1.987/(T+273))\}^{1/2} \quad (1)$$

Further, when, based on the correlation between the maximum extent of carburization, ΔC, on the pipe inner surface and the carburized depth, H, as indicated by the equation (7) given hereinabove, the relation 2.5C=4000×ΔC is substituted into the above equation (1) and the maximum extent of carburization in the inner surface of the pipe to be heat-treated but prior to the heat treatment is expressed as ΔC (%), the heating temperature for the pipe to be heat-treated in the heat treatment as T (° C.) and the time during which a decarburizing gas is blown into the inside of the pipe to be heat-treated as $t_2$ (seconds), the relation represented by the following equation (2) can be satisfied:

$$4000\times\Delta C=\{1.326\times10^8\times t_2\times \mathrm{EXP}(-37460/1.987/(T+273))\}^{1/2} \quad (2)$$

Therefore, in the production process according to the present invention, the carburized portion formed in the pipe inner surface can be decarburized and the carburized layer can be reduced by employing a blowing time longer than the time $t_1$ or $t_2$ (seconds) given from the above equation (1) or (2) as the actual decarburizing gas blowing time in the heat treatment.

In the case of conducting cold working, the carburized depth from the inner surface also decreases by the decrement (proportion) in wall thickness as caused by the cold working, so that the gas blowing time can be made shorter in the heat treatment after the cold working. More specifically, when the wall thickness of the pipe before cold working is expressed as $W_0$ and the wall thickness after cold working as $W_1$, the carburized layer can be reduced by employing a blowing time longer than the time $t_3$ or $t_4$ given from the equation (3) or (4) shown below as the actual decarburizing gas blowing time in the heat treatment.

$$(W_1/W_0)\times2.5\times C=\{1.326\times10^8\times t_3\times \mathrm{EXP}(-37460/1.987/(T+273))\}^{1/2} \quad (3)$$

$$(W_1/W_0)\times4000\times\Delta C=\{1.326\times10^8\times t_4\times \mathrm{EXP}(-37460/1.987/(T+273))\}^{1/2} \quad (4)$$

In the production process according to the present invention, the heating temperature T (° C.) for the pipe to be heat-treated in the heat treatment is desirably not less than 1000° C., more preferably not less than 1050° C., since the heat treatment is pertinent to solution heat treatment as a product heat treatment or annealing heat treatment prior to cold working. While no upper limit to the heating temperature T (° C.) is prescribed, an upper limit is desirably set at a level of 1300° C. since, at heating temperatures exceeding 1300° C., scale loss increases, not only lowering the product yield but also increasing the unit energy consumption.

Since the production process according to the present invention is to avoid such corrosion problem as stress corrosion cracking due to the carburized layer in the pipe inner surface by means of decarburization, the targets of the present invention are those stainless steels which are transformed to an austenitic phase upon heating at 1000° C. or more. As specific examples, there may be mentioned SUS 405, SUS 410, SUS 304, SUS 309, SUS 310, SUS 316, SUS 347, SUS 329, NCF 800 and NCF 825, and stainless steels equivalent to these.

The heat treatment provided by the present invention may be applied not only in a product heat treatment of hot finish-rolled steel pipes or of steel pipes derived, by cold working, from hot-rolled mother pipes to be cold-worked but also in a mother pipe annealing heat treatment when hot-rolled mother pipes to be cold-worked are subjected to an annealing heat treatment, and also, when an annealing heat treatment is carried out in an intermediate step between cold working steps, in such annealing heat treatment. Furthermore, it may be applied also in both of the mother pipe annealing heat treatment of mother pipes to be cold-worked and the product heat treatment after cold working.

Thus, the heat treatment provided by the present invention can be applied, in such hot rolling and cold working processes as shown by way of example in Table 2, in the underlined product heat treatment and/or mother pipe annealing heat treatment. In each of such heat treatment steps, it is possible to decarburize the carburized portion and reduce the inner surface carburization at the stage of product steel pipes by blowing a decarburizing gas thereinto as prescribed by the present invention. Further, in the case of application in the product heat treatment after cold working or in the intermediate annealing heat treatment between cold working steps, the decarburizing gas blowing time may be determined taking into consideration the wall thickness reduction in cold working until the heat treatment.

TABLE 2

| |
|---|
| Elongating rolling → sizing rolling → <u>product heat treatment</u> |
| Elongating rolling → sizing rolling → mother pipe annealing heat treatment → cold working → <u>product heat treatment</u> |
| Elongating rolling → sizing rolling → <u>mother pipe annealing heat treatment</u> → cold working → product heat treatment |
| Elongating rolling → sizing rolling → <u>mother pipe annealing heat treatment</u> → cold working → <u>product heat treatment</u> |

EXAMPLES

Example 1

Billets having a diameter of 200 mm and a length of 3000 mm and made of SUS 304 steel or SUS 316 steel, the compositions of which were as shown in Table 3, were prepared as raw material stainless steels to be rolled.

TABLE 3

| | Chemical composition (% by mass; remainder being Fe and impurities) | | | | | | | | JIS designa- |
|---|---|---|---|---|---|---|---|---|---|
| Steel | C | Si | Mn | P | S | Ni | Cr | Mo | tion |
| A | 0.03 | 0.30 | 1.85 | 0.020 | 0.003 | 8.2 | 18.2 | 0.09 | SUS304 |
| B | 0.03 | 0.28 | 1.80 | 0.018 | 0.002 | 8.0 | 18.1 | 2.10 | SUS316 |

These two kinds of billets were heated in a rotary hearth type heating furnace within the temperature range of 1150-1250° C., and each billet was fed to a Mannesmann piercer to give a hollow shell with an outside diameter of 200 mm and a wall thickness of 16 mm, and the hollow shell was then fed to a mandrel mill to give a finishing rolling blank pipe with an outside diameter of 110 mm and a wall thickness of 5.5 mm.

On that occasion, the mandrel bar used for elongating rolling was coated with a lubricant prepared by mixing a graphite-based lubricant and a graphite-free lubricant in an appropriate ratio so that the amount of carbon adhering to the mandrel bar surface might arrive at a level within the range of 10-80 g/m$^2$. After elongating rolling on a mandrel mill, each blank pipe was reheated in a reheating furnace at a heating temperature of 1000° C. for a retention time of 20 minutes. Then, the blankpipe was fed to a stretch reducer to give a hot-finished steel pipe with an outside diameter of 45.0 mm and a wall thickness of 5.0 mm.

The steel pipes thus obtained were descaled by pickling, namely by 60 minutes of immersion in a nitric acid-hydrofluoric acid solution and, then, heated in a product heat treatment furnace while air, as a decarburizing gas, was blown into the inside of the steel pipe to be heat-treated under various conditions; on that occasion, the heating temperature T (° C.) and the blowing time (seconds) were varied. The pipes were again immersed in a nitric acid-hydrofluoric acid solution for 60 minutes for descaling, to give final products.

For the measurement of the carbon-equivalent weight C (g/m$^2$) on the mandrel bar surface, 8 to 10 samples of the mandrel bar surface adhering substances were collected without omission from the relevant locations on each mandrel bar by polishing with a metal file until exposure of the base metal and evaluated by weight measurement and quantitative analysis of carbon to determine the maximum value of the weight of carbon adhering to the mandrel bar surface.

The maximum extent of carburization, ΔC, in the steel pipe inner surface was determined by taking test specimens for carburization analysis testing from the pipe ends of a plurality of test pipes before the product heat treatment as produced under the same conditions, submitting them to an emission spectrophotometer for the determination of C concentrations at a plurality of locations on the steel pipe inner surface, and calculating the difference between the maximum value among them and the C content in the middle of the pipe wall thickness.

Further, the maximum extent of carburization, ΔC, after the product heat treatment was evaluated in the same manner by taking test specimens for carburization analysis testing from the pipe ends of a plurality of test pipes after the product heat treatment, submitting them to an emission spectrophotometer for the determination of C concentrations at a plurality of locations on the steel pipe inner surface, and calculating the difference between the maximum value among them and the C content in the middle of the pipe wall thickness. The results of these tests are shown in Table 4.

TABLE 4

| Test | | Before heat treatment | | Heat treatment conditions | | | | After heat treatment | |
|---|---|---|---|---|---|---|---|---|---|
| | | Carbon-equivalent weight on bar surface | Maximum extent of carburization on pipe inner surface | Heating temperature | Gas blowing time (seconds): Actual blowing time | Gas blowing time (seconds): From equation (1) or (2) $t_1$ | Gas blowing time (seconds): From equation (1) or (2) $t_2$ | Maximum extent of carburization on pipe inner surface | |
| No. | Steel | C (g/m$^2$) | ΔC (%) | T (° C.) | time | $t_1$ | $t_2$ | ΔC (%) | Remark |
| 1 | A | 80 | 0.05 | 1050 | 600 | 466 | 466 | 0.010 | Inventive example |
| 2 | A | 20 | 0.012 | 1050 | 45 | 29 | 27 | 0.010 | |
| 3 | A | 80 | 0.05 | 1100 | 300 | 277 | 277 | 0.010 | |
| 4 | A | 60 | 0.038 | 1100 | 200 | 156 | 160 | 0.009 | |
| 5 | A | 40 | 0.025 | 1100 | 100 | 69 | 69 | 0.008 | |
| 6 | A | 20 | 0.013 | 1100 | 30 | 17 | 19 | 0 | |
| 7 | A | 10 | 0.007 | 1100 | 30 | 4.3 | 5.4 | 0 | |
| 8 | A | 80 | 0.05 | 1150 | 300 | 171 | 171 | 0.003 | |
| 9 | A | 20 | 0.012 | 1150 | 20 | 11 | 10 | 0 | |
| 10 | B | 80 | 0.05 | 1100 | 300 | 277 | 277 | 0.002 | |
| 11 | B | 20 | 0.012 | 1050 | 45 | 29 | 27 | 0.010 | |
| 12 | A | 80 | 0.05 | 1100 | *200 | 277 | 277 | 0.016 | Comparative example |
| 13 | A | 80 | 0.05 | 1050 | *300 | 466 | 466 | 0.016 | |
| 14 | A | 80 | 0.05 | 1150 | *120 | 171 | 171 | 0.015 | |
| 15 | B | 80 | 0.05 | 1150 | *120 | 171 | 171 | 0.016 | |

Notes:
In the table, the mark * indicates that each value fails to satisfy the requirement prescribed by the present invention.
The 0% value of ΔC after heat treatment indicates that there was no carburization on the pipe inner surface.

As shown in Table 4, the maximum extents of carburization, ΔC, after the product heat treatment were satisfactorily smaller in value than the maximum extents of carburization, ΔC, before the product heat treatment and the pipe inner surface carburized layer could be reduced in the final products when, in the product heat treatment, the decarburizing gas blowing conditions prescribed by the present invention were satisfied, namely when, in those cases where the equations (1) and (2) given hereinabove were satisfied respectively, each of the actual decarburizing gas blowing time was longer than the time $t_1$ and time $t_2$ (seconds) respectively derived from the equations (1) and (2) given hereinabove. Even in cases where the maximum extent of carburization, ΔC, before the product heat treatment is as small as about 0.01%, the maximum extent of carburization, ΔC, after the product heat treatment can be made smaller by applying the present invention.

Example 2

Billets having a diameter of 200 mm and a length of 3000 mm and made of SUS 304 steel or SUS 316 steel, the composition of which was as shown hereinabove in Table 3, were heated in a rotary hearth type heating furnace within the temperature range of 1150-1250° C., and each billet was fed to a Mannesmann piercer to give a hollow shell with an outside diameter of 200 mm and a wall thickness of 16 mm, and the hollow shell was then fed to a mandrel mill to give a finishing rolling blank pipe with an outside diameter of 110 mm and a wall thickness of 5.5 mm.

On that occasion, the mandrel bar used for elongating rolling was coated with a lubricant prepared by mixing a graphite-based lubricant and a graphite-free lubricant in an appropriate ratio so that the amount of carbon adhering to the mandrel bar surface might arrive at a level within the range of 10-80 g/m$^2$. After elongating rolling on a mandrel mill, each blank pipe was reheated in a reheating furnace at a heating temperature of 1000° C. for a retention time of 20 minutes. Then, the blank pipe was fed to a stretch reducer to give a mother pipe to be cold-worked, with an outside diameter of 45.0 mm and a wall thickness of 5.0 mm.

The thus-obtained mother pipes to be cold-worked were descaled by pickling, namely by 60 minutes of immersion in a nitric acid-hydrofluoric acid solution and, then, subjected to cold drawing on a cold drawing machine using a die and a plug to an outside diameter of 38.0 mm and a wall thickness of 4.0 mm (wall thickness reduction rate: 20%). The pipes were heated in a product heat treatment furnace while air, as a decarburizing gas, was blown into the inside of the steel pipe to be heat-treated under various conditions; on that occasion, the heating temperature T (° C.) and the blowing time (seconds) were varied. The pipes were again immersed in a nitric acid-hydrofluoric acid solution for 60 minutes for descaling, to give final products.

The measurement of the carbon-equivalent weight C ($g/m^2$) on the mandrel bar surface was carried out in the same manner as in Example 1. The maximum extent of carburization, ΔC, on the steel pipe inner surface was evaluated by taking test specimens for carburization analysis testing from the pipe ends of a plurality of test pipes before and after the product heat treatment as produced under the same conditions, subjecting them to analysis in the same manner as in Example 1 and calculating the difference between the maximum value among them and the C content in the middle of the pipe wall thickness. The results thus obtained are shown in Table 5.

ing time was longer than the time $t_1$ and time $t_2$ (seconds) respectively derived from the equations (1) and (2) given hereinabove. Even in cases where the maximum extent of carburization, ΔC, before the product heat treatment is as small as about 0.01%, the maximum extent of carburization, ΔC, after the product heat treatment can be made smaller by applying the present invention.

Furthermore, when the equations (3) and (4) taking into account the wall thickness reduction in the step of cold working were satisfied and each of the actual decarburizing gas blowing time was longer than the time $t_3$ and time $t_4$ (seconds) respectively derived from the equations (3) and (4) but the gas blowing time $t_1$ and $t_2$ respectively derived from the above-mentioned equations (1) and (2) were not satisfied (Test Nos. 17, 23 and 25), the maximum extents of carburization, ΔC, after the product heat treatment were also sufficiently small in value as compared with the maximum extents of carburization, ΔC, before the product heat treatment and, thus, the pipe inner surface side carburization could be reduced also in the final products after cold working.

INDUSTRIAL APPLICABILITY

Since it is now possible to estimate the carburized depth, H, based on the carbon-equivalent weight C ($g/m^2$) on the mandrel bar surface or the maximum extent of carburization, ΔC (%), on the pipe inner surface, even when carbon adhesion on the pipe inner surface is caused by the residue of the graphite-based lubricant used in elongating rolling using a mandrel bar, for example in mandrel mill rolling, or by the carbon

TABLE 5

| Test | | Before cold working | | Heat treatment conditions after cold working | | | | | | After heat treatment | |
|---|---|---|---|---|---|---|---|---|---|---|---|
| | | Carbon-equivalent weight on bar surface | Maximum extent of carburization on pipe inner surface | Heating temperature | Gas blowing time (seconds): Actual blowing | From equation (1) (2), (3) or (4) | | | | Maximum extent of carburization on pipe inner surface | |
| No. | Steel | C ($g/m^2$) | ΔC (%) | T (° C.) | time | $t_1$ | $t_2$ | $t_3$ | $t_4$ | ΔC (%) | Remark |
| 16 | A | 80 | 0.05 | 1050 | 600 | 466 | 466 | 298 | 298 | 0.007 | Inventive example |
| 17 | A | 80 | 0.05 | 1050 | (400) | 466 | 466 | 298 | 298 | 0.009 | |
| 18 | A | 20 | 0.012 | 1050 | 45 | 29 | 27 | 19 | 17 | 0 | |
| 19 | A | 20 | 0.012 | 1050 | 30 | 29 | 27 | 19 | 17 | 0.005 | |
| 20 | A | 10 | 0.007 | 1050 | 45 | 7 | 9 | 5 | 6 | 0 | |
| 21 | A | 10 | 0.007 | 1050 | 10 | 7 | 9 | 5 | 6 | 0.005 | |
| 22 | A | 80 | 0.05 | 1100 | 300 | 277 | 277 | 177 | 177 | 0.005 | |
| 23 | A | 80 | 0.05 | 1100 | (250) | 277 | 277 | 177 | 177 | 0.008 | |
| 24 | B | 80 | 0.05 | 1100 | 300 | 277 | 277 | 177 | 177 | 0.004 | |
| 25 | B | 80 | 0.05 | 1100 | (250) | 277 | 277 | 177 | 177 | 0.007 | |
| 26 | A | 80 | 0.05 | 1050 | *200 | 466 | 466 | 298 | 298 | 0.014 | Comparative example |
| 27 | A | 20 | 0.012 | 1050 | *10 | 29 | 27 | 19 | 17 | 0.011 | |
| 28 | A | 80 | 0.05 | 1100 | *100 | 277 | 277 | 177 | 177 | 0.014 | |

Notes:
In the table, the mark * indicates that each value fails to satisfy the requirement prescribed by the present invention.
The blowing time in the parentheses is longer than $t_3$ or $t_4$.
The 0% value of ΔC after heat treatment indicates that there was no carburization on the pipe inner surface.

As shown in Table 5, the maximum extents of carburization, ΔC, after the product heat treatment were satisfactorily smaller in value than the maximum extents of carburization, ΔC, before the product heat treatment and the pipe inner surface carburized layer could be reduced in the final products when, in the product heat treatment following cold working, the decarburizing gas blowing conditions prescribed by the present invention were satisfied, namely when, in those cases where the equations (1) and (2) given hereinabove were satisfied respectively, each of the actual decarburizing gas blow-transfer and spread from the production line, the process for producing seamless stainless steel pipes according to the present invention makes it possible to reduce the carburized layer by decarburization of the carburized portion to thereby obtain seamless steel pipes excellent in inner surface quality by controlling the heating temperature T (° C.) for the pipe to be heat-treated in the subsequent heat treatment and the decarburizing gas blowing time $t_1$ or $t_2$ (seconds) or, when cold working is conducted and then heat treatment is carried out, by controlling the blowing time $t_3$ or $t_4$ (seconds) calculated taking into account the wall thickness reduction in the step of cold working. Thus, the process is suited for use as a process for producing stainless steel pipes in which the carburization-incurred deterioration in corrosion resistance become more of an issue.

What is claimed is:

1. A process for producing seamless stainless steel pipes in which the process includes the steps of: piercing rolling; elongating rolling using a mandrel bar; and sizing rolling, followed by a product heat treatment, wherein when the carbon-equivalent weight, which is the sum of the weight of graphite in and the weight of the carbon content of organic binder in a lubricant used for the mandrel bar, per unit area of the lubricant adhering to the mandrel bar surface in the above-mentioned step of elongating rolling, is C (g/m$^2$), and a heating temperature for the pipe to be heat-treated in the above-mentioned heat treatment is T (° C.), then a decarburizing gas is blown into the inside of the pipe to be heat-treated during the above-mentioned heat treatment for a period of time longer than the estimated gas blowing time $t_1$ (seconds) satisfying the relation defined by the equation (1) given below:

$$2.5\times C=\{1.326\times10^8\times t_1\times \mathrm{EXP}(-37460/1.987/(T+273))\}^{1/2} \quad (1).$$

2. A process for producing seamless stainless steel pipes in which the process includes the steps of: piercing rolling; elongating rolling using a mandrel bar; and sizing rolling in which a carburized layer can form on the inner surface of the pipe, followed by a product heat treatment, wherein when the maximum extent of carburization in the inner surface of the pipe to be heat-treated but prior to the above-mentioned heat treatment is ΔC (% by mass), and a heating temperature for the pipe to be heat-treated in the above-mentioned heat treatment is T (° C.), then a decarburizing gas is blown into the inside of the pipe during the above-mentioned heat treatment for a period of time longer than the estimated gas blowing time $t_2$ (seconds) satisfying the relation defined by the equation (2) given below:

$$4000\times\Delta C=\{1.326\times10^8\times t_2\times \mathrm{EXP}(-37460/1.987/(T+273))\}^{1/2} \quad (2).$$

3. A process for producing seamless stainless steel pipes in which the process includes the steps of: piercing rolling; elongating rolling using a mandrel bar; and sizing rolling, followed by cold working and heat treating prior to and/or after said cold working, wherein when the carbon-equivalent weight, which is the sum of the weight of graphite in and the weight of carbon content of organic binder in a lubricant used for the mandrel bar, per unit area of the lubricant adhering to the mandrel bar surface in the above-mentioned step of elongating rolling, is C (g/m$^2$), and a heating temperature for the pipe to be heat-treated in the heat treatment prior to the above-mentioned cold working and/or in the heat treatment after the cold working is T (° C.), then a decarburizing gas is blown into the inside of the pipe during the above-mentioned heat treatment for a period of time longer than the estimated gas blowing time $t_1$ (seconds) satisfying the relation defined by the equation (1) given below:

$$2.5\times C=\{1.326\times10^8\times t_1\times \mathrm{EXP}(-37460/1.987/(T+273))\}^{1/2} \quad (1).$$

4. A process for producing seamless stainless steel pipes in which the process includes the steps of: piercing rolling; elongating rolling using a mandrel bar; and sizing rolling, in which a carburized layer can form on the inner surface of the pipe followed by cold working and heat treating prior to and/or after said cold working, wherein when the maximum extent of carburization in the inner surface of the pipe to be heat-treated but prior to the heat treatment before and/or after the above-mentioned cold working is ΔC (% by mass), and a heating temperature for the pipe to be heat-treated in the above-mentioned heat treatment is T (° C.), a decarburizing gas is blown into the inside of the pipe during the above-mentioned heat treatment for a period of time longer than the estimated gas blowing time $t_2$ (seconds) satisfying the relation defined by the equation (2) given below:

$$4000\times\Delta C=\{1.326\times10^8\times t_2\times \mathrm{EXP}(-37460/1.987/(T+273))\}^{1/2} \quad (2).$$

5. A process for producing seamless stainless steel pipes in which the process includes the steps of: piercing rolling; elongating rolling using a mandrel bar; sizing rolling; and cold working, followed by heat treatment, wherein when the carbon-equivalent weight, which is the sum of the weight of graphite in and the weight of the carbon content of organic binder in a lubricant used for the mandrel bar, per unit area of the lubricant adhering to the mandrel bar surface in the above-mentioned step of elongating rolling, is C (g/m$^2$), a heating temperature for the pipe to be heat-treated in the heat treatment following the above-mentioned cold working is T (° C.) and, further, the wall thickness of the pipe before the cold working is $W_o$ and the wall thickness of the pipe after the cold working is $W_1$, then a decarburizing gas is blown into the inside of the pipe during the above-mentioned heat treatment for a period of time longer than the estimated gas blowing time $t_3$ (seconds) satisfying the relation defined by the equation (3) given below:

$$(W_1/W_0)\times2.5\times C=\{1.326\times10^8\times t_3\times \mathrm{EXP}(-37460/1.987/(T+273))\}^{1/2} \quad (3).$$

6. A process for producing seamless stainless steel pipes in which the process includes the steps of: piercing rolling; elongating rolling using a mandrel bar; sizing rolling; in which a carburized layer can form on the inner surface of the pipe and cold working, followed by heat treatment, wherein when the maximum extent of carburization in the inner surface of the pipe to be heat-treated prior to the above-mentioned cold working is ΔC (% by mass), a heating temperature for the pipe to be heat-treated in the heat treatment following the above-mentioned cold working is T (° C.) and, further, the wall thickness of the pipe before the cold working is $W_0$ and the wall thickness of the pipe after the cold working is $W_1$, then a decarburizing gas is blown into the inside of the pipe during the above-mentioned heat treatment for a period of time longer than the estimated gas blowing time $t_4$ (seconds) satisfying the relation defined by the equation (4) given below:

$$(W_1/W_0)\times4000\times\Delta C=\{1.326\times10^8\times t_4\times \mathrm{EXP}(-37460/1.987/(T+273))\}^{1/2} \quad (4).$$

* * * * *